United States Patent [19]

Boggs et al.

[11] 3,956,028

[45] May 11, 1976

[54] TEMPORARY SCALE RETARDANT COATINGS

[75] Inventors: William E. Boggs, Franklin Boro; William A. Linderman, North Versailles Township, Allegheny County; Roland B. Snow, Mount Lebanon, all of Pa.

[73] Assignee: United States Steel Corporation, Pittsburgh, Pa.

[22] Filed: May 28, 1974

[21] Appl. No.: 473,543

Related U.S. Application Data

[62] Division of Ser. No. 291,849, Sept. 25, 1972, Pat. No. 3,827,922.

[52] U.S. Cl. ..... 148/27; 148/13.1; 148/30; 148/31.5; 148/113; 148/122

[51] Int. Cl.[2] ..... B23K 35/24

[58] Field of Search ..... 148/27, 30, 31.5, 113, 148/122, 13.1; 427/123

[56] References Cited

UNITED STATES PATENTS

| | | | |
|---|---|---|---|
| 2,889,238 | 6/1959 | Long et al. | 427/123 |
| 3,039,902 | 6/1962 | Miller et al. | 148/113 |
| 3,350,243 | 10/1967 | Schiffman | 148/27 |
| 3,671,335 | 6/1972 | Pavlik | 148/13.1 |
| 3,827,922 | 8/1974 | Boggs et al. | 148/113 |

*Primary Examiner*—Walter R. Satterfield
*Attorney, Agent, or Firm*—Arthur J. Greif

[57] ABSTRACT

A coating composition containing 75–95% MgO, 2–10% $B_2O_3$ and 0–15% C, which is effective in retarding oxidation of ferrous metal articles, especially at temperatures in excess of 2150°F. Additional protection is achieved when about 11–17% $TiO_2$ is substituted for about the same amount of MgO. The composition is admixed with a suitable vehicle and is applied to the metal surface in the form of a dispersion, suspension or as a slurry.

10 Claims, 1 Drawing Figure

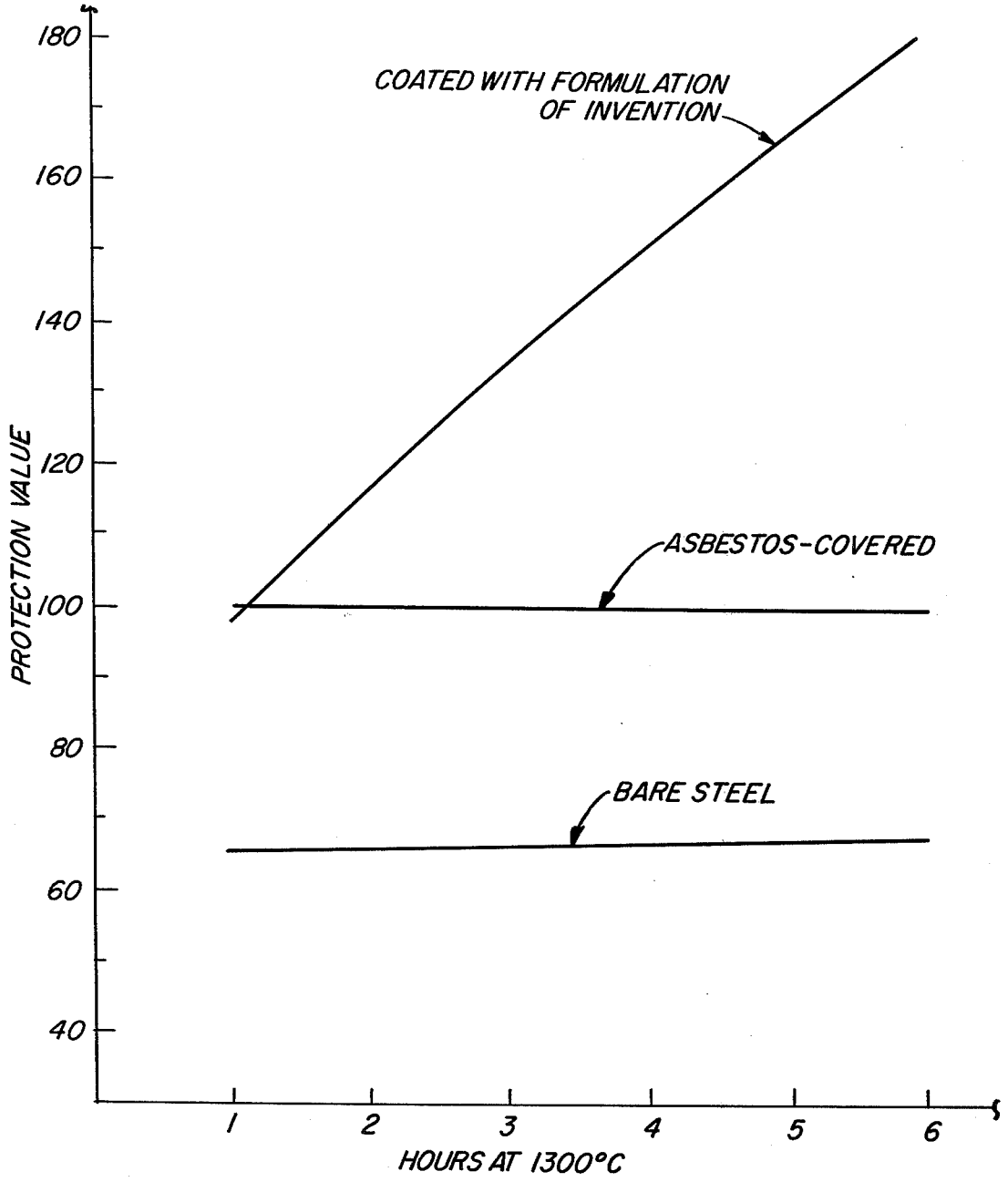
180
160
140
120
100
80
60
40
PROTECTION VALUE
COATED WITH FORMULATION OF INVENTION
ASBESTOS-COVERED
BARE STEEL
1
2
3
4
5
6
HOURS AT 1300°C

TEMPORARY SCALE RETARDANT COATINGS

This is a division of application Ser. No. 291,849, filed Sept. 25, 1972, now U.S. Pat. No. 3,827,922.

This invention is directed to a composition for reducing oxidation and scaling of ferrous articles during high temperature heat treatments.

During the heat treating of ferrous articles, the oxidation and growth of scale on the surface thereof, and its subsequent removal prior to hot rolling, results in a loss of metal that can be quite substantial. The economic loss is even more significant if the article contains appreciable amounts of expensive alloying additions. In certain of the alloy grades, additional problems are encountered. Thus, for example, the nickel-bearing grades develop scales that are abnormally tenacious and extremely difficult to remove. If such scale is rolled-in during the hot-rolling procedure, the removal of the resulting inclusions results in pits which must be subsequently removed by grinding. This results in even further material loss as well as significantly increased processing costs.

The art has employed several different methods to decrease such scaling. The use of inert or reducing atmospheres, while effective in many cases, has not been widely employed for large slabs or billets, due to the marked increase in operating cost and the significant capital investment required. Equally important, it is often necessary (as in hot rolling) to remove the slab from the controlled atmosphere furnace while still at elevated temperature. Thus, during such a procedure, excessive oxidation will nevertheless occur on exposure to the atmosphere. To overcome the well known deficiencies of controlled atmospheres, a number of ceramic type coatings have been proposed. Such coatings are normally composed of refractory oxides, e.g. alumina, silica, magnesia and fluxes, e.g. silicates, borates, phosphates in combination with a variety of other ingredients. Similarly, protective sheets of refractory materials, e.g., asbestos, have been employed to retard oxidation during heatings. These expedients have been useful in many instances. However, it has now been found that, under certain conditions, these refractory coatings, can in themselves, contribute to the formation of scale pits. It has been discovered that in many instances, such as when the temperature is in excess of about 2150° F, that such pits form by reaction of the iron oxide with the silicates in the coating. In addition to such pitting, a more generalized and accelerated attack occurs in the presence of silicates, after about three hours at temperatures above 2300°F. Because of this discovered difficulty, associated with conventional silicate containing coatings, a new coating was developed that contained essentially no siliceous materials.

The basic coating, which contains from 75 to 95% MgO, 2–10% $B_2O_3$ and 0 to 15% O (all percentages by weight) is not only more effective in providing oxidation resistance at elevated temperatures, but also enhances the formation of a scale which is more easily removed. When about 11% to about 17% $TiO_2$ is substituted for about an equivalent weight percent of MgO, corrosion protection is further enhanced; especially for short time (e.g. less than three hours) heat treatments.

Further objects and advantages of the invention will be more apparent from the following description, taken in conjunction with the appended claims and the drawing, in which:

The FIGURE is a graph depicting the protective value of a steel article utilizing the composition of this invention in comparison to that of bare steel and one covered with asbestos.

The compositions of this invention are admixed in a suitable vehicle and applied in any convenient manner. Thus, they may be admixed in the form of slurry or they may be suspended by the use of suitable dispersant. A number of particularly effective vehicles are reported in the examples below.

A computer program was written to process the experimental data obtained from each coating tested, and to compare these data with that obtained from oxidation of bare and asbestos covered, 3Ni steel, heated in air at 1300°C for 1, 2, 4 and 6 hours. In order to obtain a normalized protection value, the weight loss for the asbestos covered specimens (taken as a standard) was divided by the weight loss in the particular test and multiplied by 100. This produced an empirical graduated system of protection values in which asbestos is rated as 100 and bare steel at 67 (see the Figure). To simplify comparison, the protection numbers for the 1, 2, 4 and 6 hour exposures of each coating formulation were added and divided by 4 to provide an average protection value.

The protection values of a series of $B_2O_3$ - periclase formulations made with a vehicle - binder system consisting of 30 ml shellac in 180 ml ethanol are shown in Table I.

TABLE I

| Coating No. | Composition of Solids, % | | Protection Value (Asbestos = 100) | | | | | Average Coating Weight, g/cm² |
|---|---|---|---|---|---|---|---|---|
| | $B_2O_3$ | MgO | 1 hr. | 2 hr. | 4 hr. | 6 hr. | Average | |
| 1 | 50 | 50 | 52 | 43 | * | * | — | 0.0930 |
| 2 | 25 | 75 | 67 | 67 | 81 | 86 | 75 | 0.1067 |
| 3 | 11 | 89 | 80 | 81 | 87 | 76 | 81 | 0.0789 |
| 4 | 9 | 91 | 91 | 84 | 114 | 103 | 98 | 0.2090 |
| 5 | 7 | 93 | 87 | 86 | 123 | 119 | 104 | 0.2171 |
| 6 | 6 | 94 | 100 | 95 | 113 | 126 | 108 | 0.2018 |
| 7 | 5 | 95 | 112 | 116 | 127 | 153 | 127 | 0.1549 |

*Specimen completely oxidized.

The superiority of the $B_2O_3$-periclase coatings, especially at exposure periods greater than about 2 hours is clearly evident. Nevertheless, it was determined that further benefits could be achieved by the addition of up to about 15% finely divided carbon. Apparently, the slower burning carbon provides additional protection during the burn-out of the organic binder. The enhanced protection achieved by the addition of finely divided carbon (in this case, coke breeze) is shown in Table II, in which the same ethanolshellac, vehicle-binder system was employed.

TABLE II

| Coating No. | Composition of Solids, % | | | Protection Value (Asbestos = 100) | | | | | Average Coating Weight, g/cm² |
|---|---|---|---|---|---|---|---|---|---|
| | $B_2O_3$ | MgO | Coke | 1 hr | 2 hr | 4 hr | 6 hr | Avg | |
| 8 | 4.6 | 88.3 | 7.1 | 170 | 141 | 185 | 148 | 161 | 0.1465 |
| 9 | 4.7 | 85.0 | 10.3 | 144 | 130 | 160 | 149 | 146 | 0.1650 |
| 10 | 5 | 85 | 10 | 118 | 103 | 153 | 130 | 126 | 0.1553 |

The superiority of the instant coatings is believed to be due to the formation of magnesio-wustite solid solutions, having more protective properties than normal scale. Further studies were under taken to determine if the introduction of a third refractory oxide might further limit the solubility of FeO in MgO. Of a number of such oxides which were tried, $TiO_2$ alone, produced an improvement in the scale retardation of the basic ($MgO—B_2O_3—C$) coating. In the experiments reported in Table III, 200 grams of solids mixture were suspended in an aqueous vehicle containing 100 ml of water, 1 gram of hydroxyethyl cellulose, 13 ml of concentrated $NH_4OH$ and 10 ml of 25% ethylene acrylic acid copolymer. The results reported for the "control" sample are the average of five separate runs. Certain other of the below numbered specimens are similarly the average of more than one run.

TABLE III

| Coating No. | Composition of Solids, %[1] | | | | Protection Value | | | | | Average Coating Weight |
|---|---|---|---|---|---|---|---|---|---|---|
| | $B_2O_3$ | Coke | MgO | $TiO_2$ | 1 hr | 2 hr | 4 hr | 6 hr | Avg | |
| control | 5% | 7.1 | 87.9 | — | 113 | 125 | 134 | 129 | 128 | .1021 |
| 11 | " | " | 83.5 | 4.4 | 148 | 124 | 127 | 133 | 133 | .1028 |
| 12 | " | " | 79.1 | 8.8 | 129 | 137 | 114 | 86 | 116 | .1152 |
| 13 | " | " | 74.7 | 13.2 | 160 | 162 | — | 205 | 175 | .1326 |
| 14 | " | " | 73.4 | 14.5 | 164 | 146 | 121 | 104 | 134 | .1149 |
| 15 | " | " | 73.0 | 14.9 | 180 | 163 | 110 | 111 | 141 | .1025 |
| 16 | " | " | 72.5 | 15.4 | 218 | 196 | 207 | 149 | 192 | .1089 |
| 17 | " | " | 72.1 | 15.8 | 177 | 113 | 119 | 132 | 135 | .1103 |
| 18 | " | " | 71.6 | 16.3 | 181 | 153 | 113 | 116 | 141 | .1146 |
| 19 | " | " | 70.3 | 17.6 | 117 | 92 | 118 | 77 | 101 | .1402 |

[1] Total solids content, in all cases, equaled 200 grams.

The effectiveness of $TiO_2$ additions within the range of about 11 to about 17% $TiO_2$ is especially marked for short (e.g. less than 3 hours) annealing times. For periods of 4 hours and greater the $TiO_2$ containing coatings are about equal in protection value to those in which no $TiO_2$ is employed.

The composition of this invention may therefore be formulated in the following manner.

When $TiO_2$ within the preferred range of about 11 to about 17 percent is employed, the MgO content of the solids fraction may range from about 65 to 80 percent. Significantly lower values of $TiO_2$, e.g. 1 to 8 percent, may be detrimental to the basic ($MgO—B_2O_3—C$) coating. When $TiO_2$ within the preferred range is not employed, the MgO content of the solids fraction should always be greater than about 75 percent, and preferably greater than about 82 percent (depending somewhat on the concentration of the other ingredients).

Various forms of MgO, such as magnesite and precipitated magnesia will provide some protection. However, the denser grained periclase has been found to provide significantly enhanced protection. Because of the above-mentioned detrimental effect of $SiO_2$, the periclase should be as pure as possible. In all cases, the $SiO_2$ content should be below 2 percent and preferably less than 1 percent. It is desirable that the particles be finer than 60 mesh, especially if the coating is to be sprayed (as opposed to painting). For some unknown reason, if the periclase particle sizes are within the very narrow range of 120–140 mesh, the protection afforded is markedly increased.

If the borate content is less than about 2 percent in the solids fraction, there is a loss of coating adherence at high temperatures and the protection afforded is inferior to that of asbestos. However, no more than about 10 percent borate should be employed, since this ingredient tends to increase the scaling rate in a manner somewhat analogous to that of $SiO_2$. A particularly desirable range utilizes from about 5.0 to about 7.5 percent $B_2O_3$. Since it is preferable to avoid the addition of extraneous cations, the borate should be supplied either as (anhydrous) $B_2O_3$ or as boric acid.

Although C in any amount up to about 15% will provide enhanced protection, it is preferable to employ greater than about 6%. Any well known source of finely divided C, e.g. lamp black, coke breeze, is acceptable. During the initial portion of the annealing treatment, the C burns out of the coating. Therefore, to prevent undue porosity, C in excess of about 12 percent (solids fraction) or particle sizes in excess of 60 mesh should preferably be avoided. Maximum benefit is achieved if the particle size is finer than 200 mesh.

Depending on the method of application and the heattreating parameters, a variety of vehicle-binder formulations may be employed. The vehicle, itself, may be either organic or water base. For safety purposes, a water-base vehicle may be preferable. While solids content may vary from as low as 10% to as high as 80%, a more limited range, e.g. 40–70% is preferable, especially if spraying is employed. Thus, with a solids content below about 40%, excessive heating would be required to evaporate the vehicle, while a solids content in excess of 70% could be difficult to spray. The suspension of solids in water requires a thickener to increase the viscosity and a dispersant to keep the particles in suspension. A binder is required to provide "green strength" (low temperature cohesion) for the coating. However, when the total organic matter (thickener plus binder) exceeded about 2 percent of the total weight of the solids, the coating in some instances tended to pull away from the substrate, even though the binder provided excellent cohesion of the particles.

A specific example employing a preferred water base formulation (i.e., that described in the FIGURE) is given below. The vehicle-binder system consisted of the following:

1. 100 ml $H_2O$
2. 1 gm carboxy ethyl cellulose
3. 13 ml $NH_4OH$
4. 10 ml - 24% ethylene acrylic acid copolymer The ingredients are added and mixed in the order given, to maintain the effectiveness of the copolymer. The solids that actually form the coating are mixed and blended separately, in the following proportions 178 gm periclase - 60 mesh
10 gm $B_2O_3$
12 gm Fine Coke Breeze (Petroleum).

The solids fraction is then added to the water-base vehicle, with stirring, and is sprayed on to the steel slab to be protected.

Regardless of the vehicle-system and the method of application, the coating should be applied in a thickness ranging from at least about 0.04 gm/cm$^2$ to no greater than about 0.25 gm/cm$^2$. Below 0.04 gm/cm$^2$ protection is totally insufficient. To insure adequate protection for a period greater than about three hours, it is preferable to employ a coating of at least about 0.08 gm/cm$^2$ in thickness. The upper limit of 0.25 gm/cm$^2$ is dictated by the tendency of thicker coatings to spall-off due to thermal shock. To further minimize this tendency, a more preferred upper limit is about 0.15 gm/cm$^2$ in thickness.

We claim:

1. A composition for effectively retarding the formation of scale at temperatures in excess of about 2150°F, comprising a solids fraction in suitable vehicle, said solids fraction amounting to from about 10 to about 80 percent of the total, and consisting essentially of a. 75 to 95 percent MgO,
b. 2 to 10 percent $B_2O_3$,
c. about 6 to about 12 percent C, and
d. less than 2 percent $SiO_2$.

2. The composition of claim 1, wherein said MgO is periclase and substantially all said MgO and said C is of a particle size finer than 60 mesh.

3. The composition of claim 2, wherein said solids fraction is from about 40 to about 70 percent and said $SiO_2$ content is less than about 1 percent.

4. The composition of claim 3, wherein said periclase is greater than about 82 percent, said $B_2O_3$ is from about 5 to about 7.5 percent.

5. The composition of claim 4, wherein substantially all said periclase particles fall within the range of 120–140 mesh, and substantially all said C particles are finer than 200 mesh.

6. The composition of claim 5, wherein said vehicle is principally water and contains a small amount of an organic dispersant and an organic binder, the total organic content being less than about 2 percent.

7. A composition for effectively retarding the formation of scale at temperatures in excess of about 2150°F, comprising a solids fraction in suitable vehicle, said solids fraction amounting to from about 10 to about 80 percent of the total, and consisting essentially of a. 65 to 80 percent MgO,
b. 2 to 10 percent $B_2O_3$,
c. 11 to 17 percent $TiO_2$,
d. 6 to 12 percent C, and
e. less than 2 percent $SiO_2$.

8. The composition of claim 7, wherein said solids fraction is from about 40 to about 70 percent and said $SiO_2$ content is less than about 1 percent.

9. The composition of claim 8, wherein said $B_2O_3$ is from about 5 to about 7.5 percent.

10. The composition of claim 9, wherein said vehicle is principally water and contains a small amount of an organic dispersant and an organic binder, the total organic content being less than about 2 percent.

* * * * *